US011631953B2

(12) United States Patent
Chen

(10) Patent No.: US 11,631,953 B2
(45) Date of Patent: Apr. 18, 2023

(54) MFI-CERTIFIED DIGITAL DATA CABLE

(71) Applicant: Dongguan Xcoso Electronic Technology Co., Ltd, Guangdong (CN)

(72) Inventor: Yi Chen, Guangdong (CN)

( * ) Notice: Subject to any disclaimer, the term of this patent is extended or adjusted under 35 U.S.C. 154(b) by 61 days.

(21) Appl. No.: 17/369,987

(22) Filed: Jul. 8, 2021

(65) Prior Publication Data

US 2022/0407270 A1 Dec. 22, 2022

(30) Foreign Application Priority Data

Jun. 16, 2021 (CN) ..... 202121341661.2

(51) Int. Cl.
*H01R 13/717* (2006.01)
*H01R 12/70* (2011.01)

(52) U.S. Cl.
CPC ..... *H01R 13/7175* (2013.01); *H01R 12/7076* (2013.01)

(58) Field of Classification Search
CPC ..... H01R 13/7175; H01R 12/7076
USPC ..... 439/490
See application file for complete search history.

(56) References Cited

U.S. PATENT DOCUMENTS

| | | | | |
|---|---|---|---|---|
| 9,620,913 | B2 * | 4/2017 | Wang | H01R 27/02 |
| 10,931,047 | B2 * | 2/2021 | Lee | H01R 12/78 |
| 2004/0071410 | A1 * | 4/2004 | Ma | H01R 13/6641 385/88 |
| 2014/0156879 | A1 * | 6/2014 | Wong | G06F 11/3055 710/19 |

FOREIGN PATENT DOCUMENTS

| | | | |
|---|---|---|---|
| CN | 103986040 | A * | 8/2014 |
| CN | 203951009 | U * | 11/2014 |
| CN | 203983681 | U * | 12/2014 |
| CN | 204088822 | U * | 1/2015 |
| CN | 204361424 | U * | 5/2015 |
| CN | 204706726 | U * | 10/2015 |
| CN | 204966916 | U * | 1/2016 |
| CN | 204992627 | U * | 1/2016 |
| CN | 105322397 | A * | 2/2016 |
| CN | 208078316 | U * | 11/2018 |
| CN | 110707495 | A * | 1/2020 |
| CN | 209982122 | U * | 1/2020 |
| CN | 210629154 | U * | 5/2020 |
| CN | 210894646 | U * | 6/2020 |

* cited by examiner

*Primary Examiner* — Peter G Leigh
(74) *Attorney, Agent, or Firm* — Prakash Nama; Global IP Services, PLLC

(57) ABSTRACT

The present utility model discloses a MFi-certified digital data cable comprising a wire rod which is equipped with an input connector at one end and an output connector at the other end; the output connector comprises a MFi-certified connector, a circuit board, a Nixie tube and a rubber base; a connecting piece is fixed at the position adjoining the tail-end of the MFi-certified connector; a plurality of conductive terminals are fixed inside the connecting piece, two ends of each conductive terminal pass through two ends of the connecting piece and then are connected with the MFi-certified connector and the circuit board respectively so the circuit board is assembled and fixed via the connecting piece.

9 Claims, 4 Drawing Sheets

MFI-CERTIFIED DIGITAL DATA CABLE

BACKGROUND OF THE INVENTION

The present utility model relates to the technical field of data cable products, in particular relates to a MFi-certified digital data cable which can display the charging information.

In the electron industry at present, data cables are still the main tool for charging and data transmission of electronic equipment (such as smart phones). The disadvantage of conventional data cables is that after a mobile phone and its charger are connected, the mobile phone will start to be charged but its user cannot intuitively see the real-time charging parameters such as charging voltage, current, power, etc. For this reason, someone invented the data cables integrated with the function of digital display wherein the digital display module can be placed on either the input connector or the output connector. However, relatively speaking, it is more difficult to place the digital display module on the output connector, especially obvious for the iPhone data cables. This is mainly because an important characteristic of the Lightning connector of an iPhone data cable is miniaturization. However, it is the miniaturization that makes the connector size fixed and relatively small, resulting in the problem that the Nixie tube, PCBA and other accessories of the digital display module cannot be contained. Even if the accessories are barely installed, the connection is unreliable and unstable, Therefore, this problem makes it very difficult to add a digital display module to the MFi-certified digital data cable of an iPhone.

BRIEF SUMMARY OF THE INVENTION

The technical problem that the present utility model aims to solve is to provide a MFi-certified digital data cable which can realize a simple structure, a stable internal structure of output connector, reliable connection and the function of digital display.

In order to solve the technical problem described above, the present utility model adopt the following technical solution: a MFi-certified digital data cable comprises a wire rod which is equipped with an input connector at one end and an output connector at the other end; the output connector comprises a MFi-certified connector, a circuit board, a Nixie tube and a rubber base; the Nixie tube and the circuit board are connected together to realize the function of digital display; the circuit board connects the wire rod and the MFi-certified connector respectively, wherein a connecting piece is fixed at the position adjoining the tail of the MFi-certified connector, a plurality of conductive terminals are fixed inside the connecting piece, two ends of each conductive terminal pass through two ends of the connecting piece and then are connected with the MFi-certified connector and the circuit board respectively so the circuit board is assembled and fixed via the connecting piece.

Further, the rear of the MFi-certified connector is clipped tightly and fixed via the assembling groove inside the connecting piece; the lower part of the tail-end of the connecting piece extends two supporting parts out backwards, the circuit board is supported and fixed via the supporting parts; the front end of each conductive terminal is welded and fixed together with the rear of the MFi-certified connector; the tail-ends of the conductive terminal extend out backwards from the supporting parts and are welded and fixed together with the circuit board.

Further, two locating projections protruding backwards are installed above the supporting parts at the tail-end of the connecting piece, two locating slots matching the locating projections are installed at the front edge of the circuit board which clips the locating projections via the locating slots in order to be connected and fixed together with the connecting piece and supported by the supporting parts. This structure is convenient for installation and stable connection so that the circuit board will not come loose from the conductive terminals even under the action of external forces.

Further, the MFi-certified digital data cable also comprises a shielding case made of metal; the shielding case is installed onto the rear of the MFi-certified connector; the lower part of the tail-end of the shielding case extends two welding handles on both sides and the welding handles are welded and fixed together with the bottom surface of the circuit board in order to enhance the structural stability and the breaking performance of the circuit board; the shielding case and the MFi-certified connector are welded and fixed via laser to stabilize their assembly structure and thus enhance the product stability.

Further, the MFi-certified digital data cable also comprises a protective sheathing made of soft rubber wherein the protective sheathing wraps the Nixie tube and its edges in order to prevent the Nixie tube from loosening and enhance the assembly stability of the Nixie tube on the circuit board, and the formed rubber base fixes the protective sheathing inside it and is equipped with a metal casing or a rubber casing outside it.

Further, the MFi-certified digital data cable also comprises a semi-transparent glass which is located on the rubber base and covers the Nixie tube to realize the waterproof effect.

The circuits on the circuit board include a power input circuit, a load output circuit, a digital display circuit and a control circuit; the control circuit connects the power input circuit and the load output circuit which connects the power input circuit and the control circuit; the power input circuit comprises a voltage-stabilizing chip U1 with the model of HT7550, the "IN" pin of the voltage-stabilizing chip U1 is connected to the power input terminal and the "OUT" pin is connected to the Pin 1 of the main control chip to provide power.

The control circuit uses a chip U2 as the main control chip with the model of NY8B062D; Pin 2, Pins 4-6 and Pin 9 of the control chip U2 are connected to the corresponding pins of the Nixie tube respectively.

Preferably, the input connector is a connector Type-C or a USB male connector A.

The present utility model aims at the problem that it is difficult to directly weld and fix the circuit board because the MFi-certified connector is small; it is clipped and fixed with the connecting piece via the rear of the MFi-certified connector, is equipped with a structure on the connecting piece for assembling the circuit board so that the circuit board and the MFi-certified connector can be assembled securely at the same time and the rear space of the MFi-certified connector is utilized fully to ensure that the connecting piece actually does not occupy additional space and thus the MFi-certified connector realizes the function of digital display. Additionally, the circuit board is fixed via the welded and fixed connecting piece to obviously enhance the intensity of the assembly structure inside the connectors, realize more stable and reliable connection between the circuit board and the conductive terminals.

Figure 1:
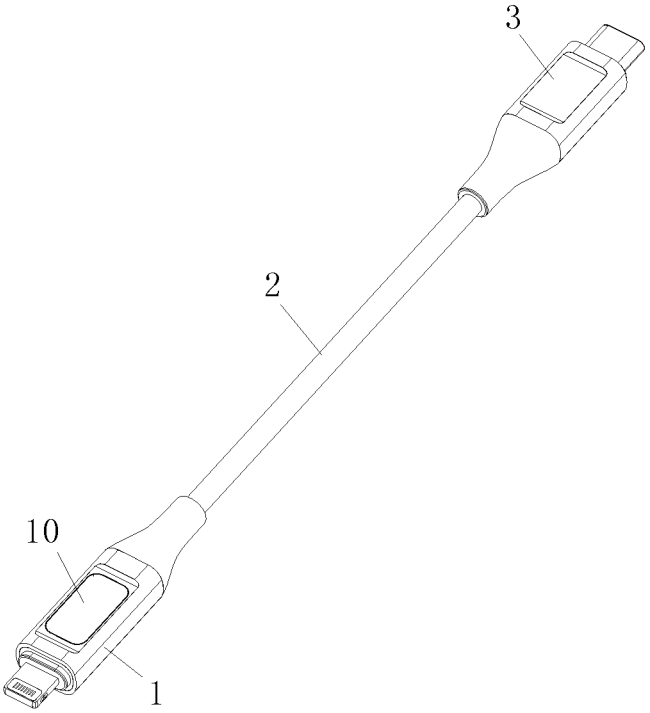
FIG. 1 is a schematic structural view of the present utility model.
Figure 2:
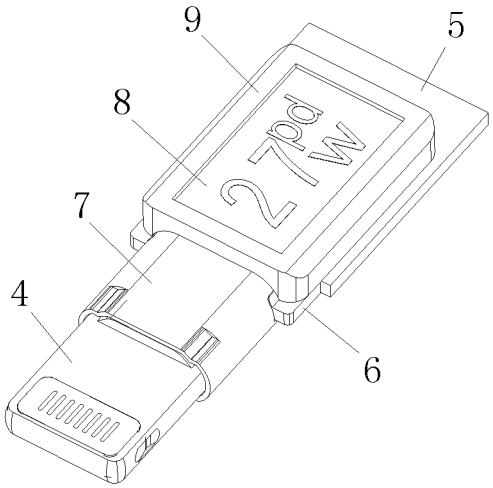
FIG. 2 is a schematic assembly structural view of the Nixie tube in the present utility model.
Figure 3:
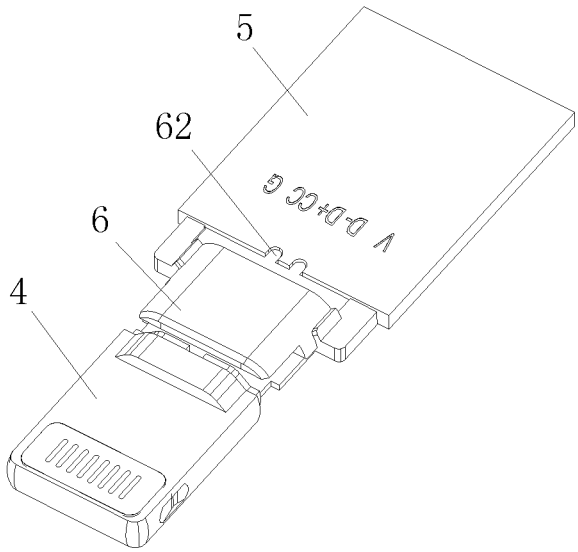
FIG. 3 is a schematic assembly structural view of the circuit board in the present utility model.
Figure 4:
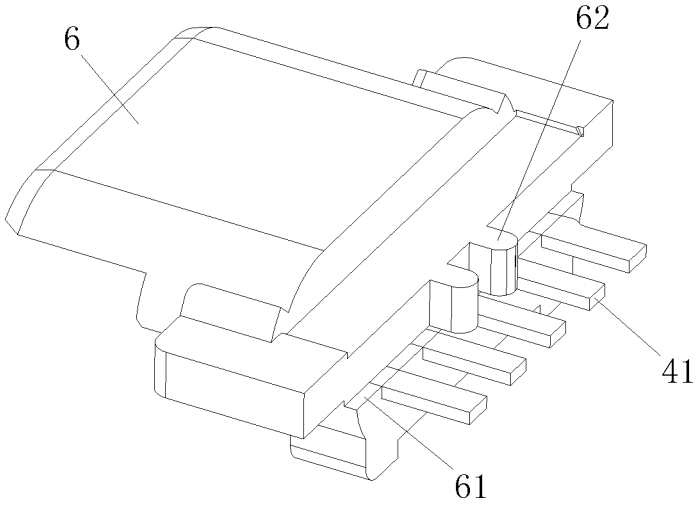
FIG. 4 is a schematic adapting view of the connecting piece with the conductive terminals in the present utility model.

In the figures, 1-output connector; 2-wire rod; 3-input connector; 4-MFi-certified connector; 41-conductive terminal; 5-circuit board; 6-connecting piece; 61-supporting part; 62-locating projection; 7-shielding case; 8-Nixie tube; 9-protective sheathing; 10-glass; 11-rubber base; 12-metal casing.

DETAILED DESCRIPTION OF THE INVENTION

In the present embodiment, referring to FIG. 1 to FIG. 4, the MFi-certified digital data cable comprises a wire rod (2) which is equipped with an input connector (3) at one end and an output connector (1) at the other end; wherein the output connector (1) comprises a MFi-certified connector (4) (i.e., Lightning connector), a circuit board (5), a Nixie tube (8) and a rubber base (11); the exterior of the rubber base (11) is a metal casing (11), the Nixie tube (8) and the circuit board (5) are connected together to realize the function of digital display; the circuit board (5) is connected with the wire rod (2) and the MFi-certified connector (4) respectively; a connecting piece (6) is welded and fixed at the position adjoining the tail of the MFi-certified connector (4); both the tail of the connecting piece (6) and the tails of the conductive terminals (41) of the MFi-certified connector (4) extend out backwards and basically align; the circuit board (5) is assembled and fixed via the connecting piece (6) and welded together with the conductive terminals (41). A plurality of conductive terminals (41) is fixed inside the connecting piece (6), two ends of each conductive terminal (41) pass through two ends of the connecting piece (6) and then are connected with the MFi-certified connector (4) and the circuit board (5) respectively so that the circuit board (5) is connected with the MFi-certified connector (4) and the circuit board (5) is assembled and fixed via the connecting piece (6).

The connecting piece (6) is made of plastic, the rear of the MFi-certified connector (4) is clipped tightly and fixed via the assembling groove inside the connecting piece (6), meaning convenient assembly; the lower part of the tail-end of the connecting piece (6) extends two supporting parts (61) out backwards, the circuit board (5) is supported and fixed via the supporting parts (61); the front end of each conductive terminal (41) is welded and fixed together with the rear of the MFi-certified connector (4); the ends of the conductive terminals (41) extend out backwards from the supporting parts (61) and are welded and fixed together with the circuit board (5) so that the circuit board (5) is connected with good stability.

Two locating projections (62) protruding backwards are installed above the supporting parts (61) at the tail-end of the connecting piece (6), two locating slots matching the locating projections (62) are installed at the front edge of the circuit board (5) which clips the locating projections (62) via the locating slots in order to be connected and fixed together with the connecting piece (6) and supported by the supporting parts (61) and thus realize stable and reliable connection. This structure is convenient for installation and stable connection so that the circuit board (5) will not come loose from the conductive terminals (41) even under the action of external forces.

The MFi-certified digital data cable also comprises a shielding case (7) made of metal; the shielding case (7) is installed onto the rear of the MFi-certified connector (4) to cover the main part of the connecting piece (6) and the conductive terminals inside it and thus realize the function of electromagnetic shielding; the lower part of the tail-end of the shielding case (7) extends two welding handles on both sides and the welding handles are welded and fixed together with the bottom surface of the circuit board (5) in order to enhance the structural stability and the breaking performance of the circuit board (5); the shielding case (7) and the MFi-certified connector (4) are welded and fixed via laser to stabilize their assembly structure and thus enhance the product stability.

The MFi-certified digital data cable also comprises a protective sheathing (9) made of soft rubber wherein the protective sheathing (9) wraps the Nixie tube (8) and its edges in order to prevent the Nixie tube (8) from loosening and enhance the assembly stability of the Nixie tube (8) on the circuit board (5), and the formed rubber base (11) fixes the protective sheathing (9) inside it and is equipped with a metal casing (12) or a rubber casing outside it.

The MFi-certified digital data cable also comprises a semi-transparent glass (10) which is located on the rubber base (11) and covers the Nixie tube (8) to realize the waterproof effect.

Figure 5:
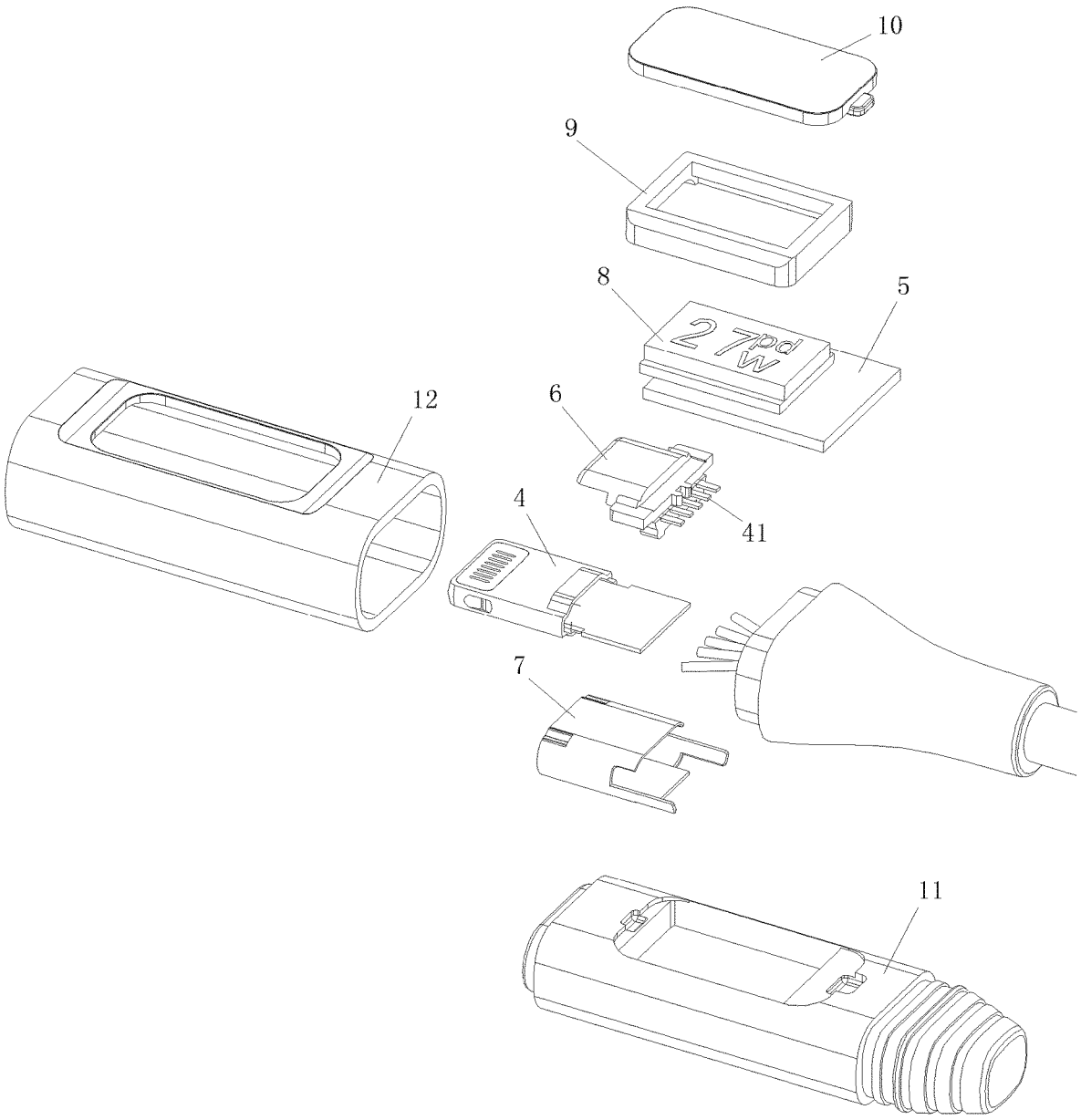
FIG. 5 is an exploded view of the main part of the output connector in the present utility model.
Figure 6:
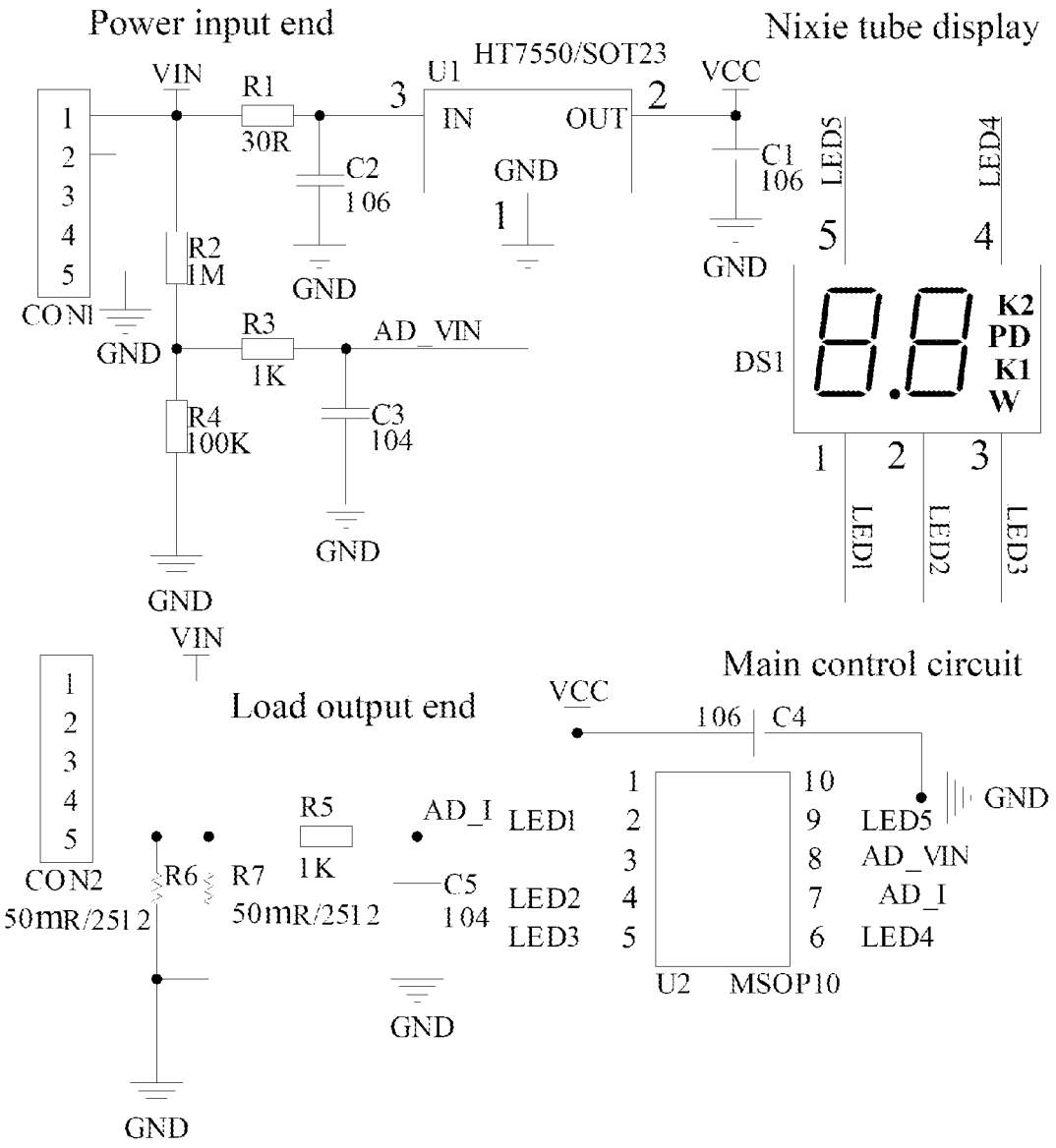
FIG. 6 is a circuit diagram of the output connector in the present utility model.

Referring to FIG. 5, the circuits on the circuit board include a power input circuit, a load output circuit, a digital display circuit and a control circuit; the control circuit connects the power input circuit and the load output circuit which connects the power input circuit and the control circuit; the power input circuit comprises a voltage-stabilizing chip U1 with the model of HT7550, the "IN" pin of the voltage-stabilizing chip U1 is connected to the power input terminal and the "OUT" pin is connected to the Pin 1 of the main control chip to provide power.

The control circuit uses a chip U2 as the main control chip with the model of NY8B062D; Pin 2, Pins 4-6 and Pin 9 of the control chip U2 are connected to the corresponding pins of the Nixie tube respectively.

The input connector is a connector Type-C(or a USB male connector A).

The present utility model has been described in detail; the described embodiments are merely the preferred embodiments of the present utility model and cannot be understood to limit the embodiment scope of the present utility model; equivalent changes and modifications made within the scope of the present application should belong to the scope covered by the present utility model.

What is claimed is:

1. A MFi-certified digital data cable comprises a wire rod which is equipped with an input connector at one end and an Output connector at the other end; the output connector comprises a MFi-certified connector, a circuit board, a Nixie tube and a rubber base; the Nixie tube and the circuit board are connected together to realize the function of digital display; the circuit board connects the wire rod and the MFi-certified connector respectively, wherein a connecting piece is fixed at position adjoining the tail of the MFi-certified connector, a plurality of conductive terminals are fixed inside the connecting piece, one end of each conductive terminal passes through first end of the connecting piece and connected with the MFi-certified connector, then another end of said conductive terminal passes through a second end of the connecting piece and connected with the circuit board so the circuit board is assembled and fixed via the connecting piece.

2. The MFi-certified digital data cable in accordance with claim 1 wherein the rear of the MFi-certified connector is clipped tightly and fixed via the assembling groove inside the connecting piece: the lower part of the tail-end of the connecting piece extends two supporting parts out backwards, the circuit board is supported and fixed via the supporting parts; the front end of each conductive terminal is welded and fixed together with the rear of the MFi-certified connector: the ends of the conductive terminal extend out backwards from the supporting parts and are welded and fixed together with the circuit board so that the circuit board is connected with good stability.

3. The MFi-certified digital data cable in accordance with claim 2, wherein two locating projections protruding backwards are installed above the supporting parts at the tail-end of the connecting piece, two locating slots matching the locating projections are installed at the front edge of the circuit board which clips the locating projections via the locating slots in order to be connected and fixed together with the connecting piece and supported by the supporting parts.

4. The MFi-certified digital data cable in accordance with claim 2, wherein it also comprises a shielding case made of metal; the lower part of the tail-end of the shielding case extends two welding handles on both sides and the welding handles are welded and fixed together with the bottom surface of the circuit board; the shielding case is installed onto the rear of the MFi-certified connector to cover the main part of the connecting and the conductive terminals; the shielding case and the MFi-certified connector are welded and fixed via laser.

5. The MFi-certified digital data cable in accordance with claim 1, wherein it also comprises a protective sheathing made of soft rubber, the protective sheathing wraps the Nixie tube and its edges, and the formed rubber base fixes the protective sheathing inside.

6. The MFi-certified digital data cable in accordance with claim 1, wherein it also comprises a semi-transparent glass which is located on the rubber base and covers the Nixie tube.

7. The MFi-certified digital data cable in accordance with claim 1, wherein the circuits on the circuit board include a power input circuit, a load output circuit, a digital display circuit and a control circuit; the control circuit connects the power input circuit and the load output circuit which connects the power input circuit and the control circuit; the power input circuit comprises a voltage-stabilizing chip U1 with the model of HT7550, the "IN" pin of the voltage-stabilizing chip U1 is connected to the power input terminal and the "OUT" pin is connected to the Pin 1 of the main control chip to provide power.

8. The MFi-certified digital data cable in accordance with claim 7, wherein the control circuit uses a chip U2 as the main control chip with the model of NY8BQ62D; Pin 2, Pins 4~6 and Pin 9 of the control chip U2 are connected to the corresponding pins of the Nixie tube respectively.

9. The MFi-certified digital data cable in accordance with claim 1, wherein the input connector is a connector Type-C or a USB male connector A.

* * * * *